United States Patent [19]

Solomon et al.

[11] 4,383,630

[45] May 17, 1983

[54] RAIL LIFTING AND CUTTING MACHINE

[76] Inventors: Steven P. Solomon, 2949 Harrison, Paducah, Ky. 42001; James L. Dunaway, Grand Chain, Ill. 62941

[21] Appl. No.: 246,409

[22] Filed: Mar. 23, 1981

[51] Int. Cl.[3] ..... B26F 3/00

[52] U.S. Cl. ..... 225/103; 104/7 R; 225/1

[58] Field of Search ..... 225/103, 1, 96, 5; 104/7 R, 2 R

[56] References Cited

U.S. PATENT DOCUMENTS

| | | | |
|---|---|---|---|
| 518,416 | 4/1894 | Miller et al. | 225/103 |
| 1,284,312 | 11/1918 | Glover | 225/103 |
| 1,430,916 | 10/1922 | Mason et al. | 104/7 R |
| 2,309,262 | 1/1943 | Thies | 104/7 R |
| 2,334,940 | 11/1943 | LeToumeau | 225/103 |
| 2,354,323 | 7/1944 | Layton | 225/103 X |
| 2,526,362 | 10/1950 | Johnston | 225/103 X |
| 3,924,012 | 12/1975 | Marshall et al. | 225/103 X |
| 4,136,618 | 1/1979 | Boyer | 104/7 R |

*Primary Examiner*—Frank T. Yost

*Attorney, Agent, or Firm*—Dithmar, Stotland, Stratman & Levy

[57] ABSTRACT

An apparatus or machine for simultaneously removing and in situ severing of rails from a rail bed to produce a plurality of rail sections of predetermined lengths including a sled frame defining a rail channel with a block or blade mounted on the sled frame across the rail channel at the rear thereof. Ram means are mounted on the sled frame above the rail channel spaced from the block and moves along a ram path extending from a level above the rail channel to a level below the rail channel. Control mechanism is associated with the ram means for actuating the ram to travel along the ram path to contact a rail and force same against the block or blade to cause the rail to fracture, continued movement of the sled frame along the rail bed and continued operation of the ram means causing the rails to be lifted from the rail bed to be cut into predetermined lengths.

10 Claims, 6 Drawing Figures

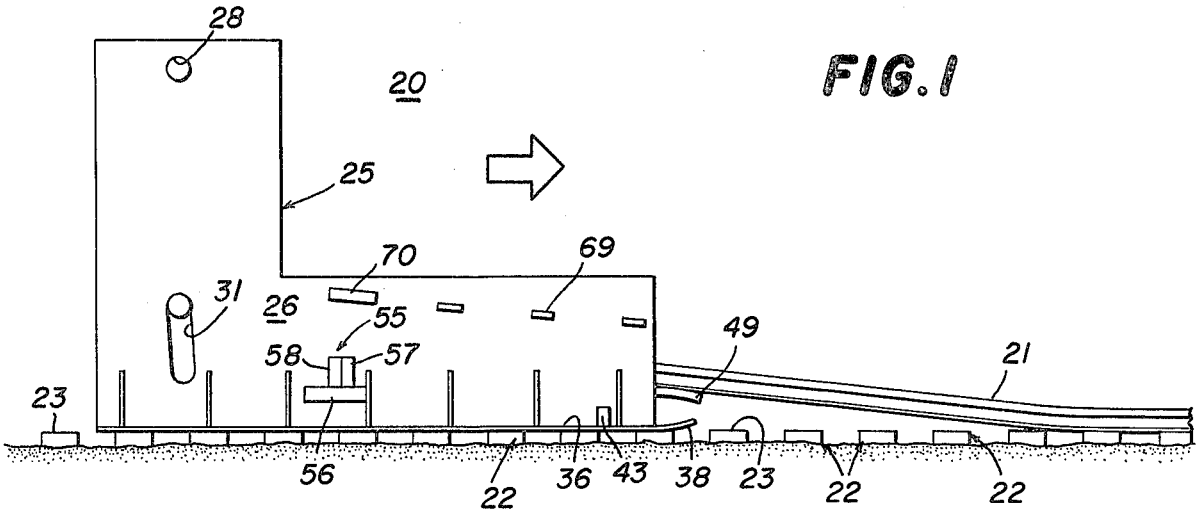
FIG. 1
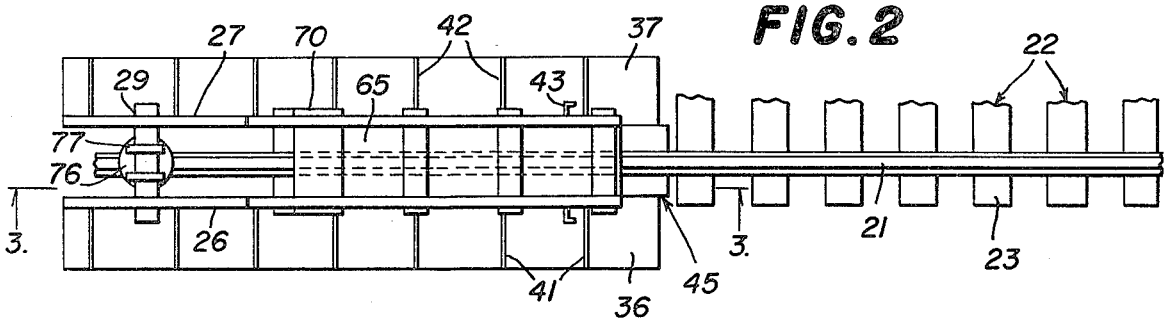
FIG. 2
FIG. 5
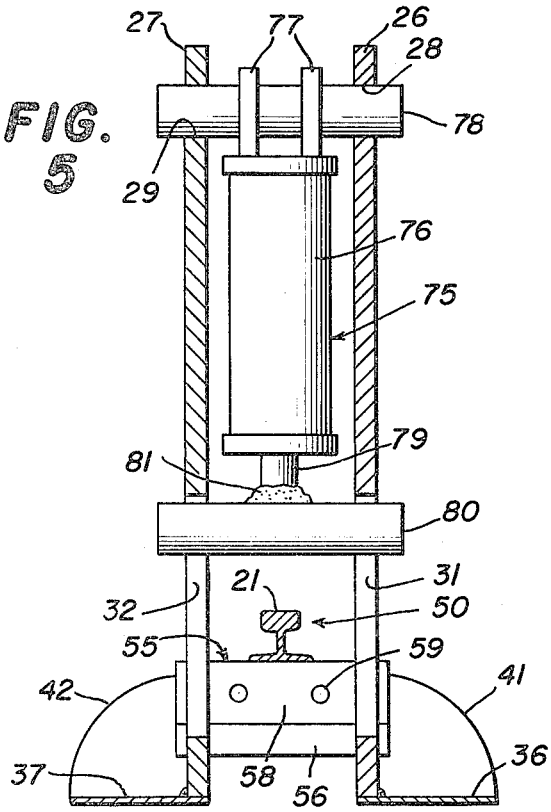
FIG. 6
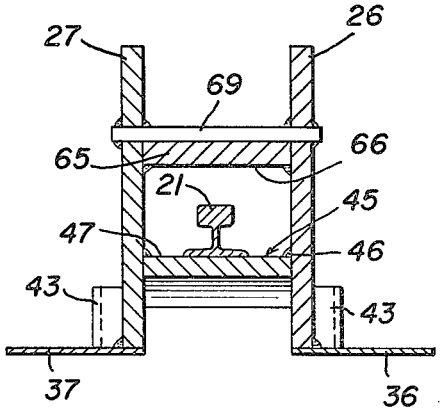

RAIL LIFTING AND CUTTING MACHINE

BACKGROUND OF THE INVENTION

The present invention relates to machines or apparatus for simultaneously removing and in situ severing of rails from a rail bed to produce a plurality of rail sections of predetermined lengths. It is often desirable, as railway routes are discontinued to recover the rails for later sale. Presently, it is common practice to pry the rails from the railway bed and thereafter transport the rails by truck or the like to a suitable site where they are cut into pieces of convenient lengths, such as one foot or so. As may be imagined, this entails additional time, transportation and handling as compared to a system wherein the rails may be pried and severed in situ to the appropriate length and shipped to the final destination directly from the railroad right-of-way.

Prior art devices which are pertinent are illustrated in U.S. Pat. No. 1,430,916 issued to Mason et al. Oct. 3, 1922 for Machine For Removing Rails and Extracting Spikes, U.S. Pat. No. 2,309,262 issued Jan. 26, 1943 to Thies for Apparatus For A Method Of Removing Abandoned Street Car Tracks and U.S. Pat. No. 4,136,618 issued Jan. 30, 1979 to Boyer for Railroad Lifting Device For Ballast Cleaning and Levelling Machines. These patents, while pertinent, do not show or suggest a machine or apparatus for simultaneously removing and in situ severing of rails from a rail bed.

SUMMARY OF THE INVENTION

This invention relates to an apparatus or machine for simultaneously removing and in situ severing of railroad rails from a rail bed to produce rail sections to predetermined lengths.

An important object of the present invention is to provide apparatus for simultaneously removing and in situ severing of rails from a rail bed to produce a plurality of rail sections of predetermined lengths comprising a sled frame defining a rail channel, a block mounted on the sled frame across the rail channel at the rear thereof, ram means mounted on the sled frame above the rail channel spaced from the block, means defining a ram path from a level above the rail channel to a level below the rail channel, and control mechanism associated with the ram means for actuating the ram to travel along the ram path to contact a rail and force same against the block to cause the rail to fracture, continued movement of the sled frame along the rail bed and continued operation of the ram means causing the rails to be lifted from the rail bed and to be cut into predetermined lengths.

Another object of the present invention is to provide an apparatus of the type set forth wherein the rail channel has a bottom plate extending forwardly and downwardly beyond the sled frame to facilitate the passage of the rail into the channel.

Yet another object of the present invention is to provide an apparatus of the type set forth in which the ram means includes a hydraulic cylinder pivotally mounted to the sled frame.

Still another object of the present invention is to provide an apparatus of the type set forth in which the ram path is defined by a pair of registered slots in the sled frame, the slots being inclined away from the vertical to ensure that the ram remains in perpendicular relation to the rail as it bends same around the block.

These and other objects of the present invention may be more readily understood when taken in conjunction with the accompanying specification and drawings, in which:

BRIEF DESCRIPTION OF THE DRAWINGS

FIG. 1 is a side elevational view of the apparatus of the present invention situated on a railway bed showing a rail in position to be severed;

FIG. 2 is a plan view of the apparatus illustrated in FIG. 1;

FIG. 5 is a view in section of the apparatus illustrated in FIG. 3 as seen along line 5—5 thereof; and FIG. 6 is a view in section of the apparatus illustrated in FIG. 3 as seen along the line 6—6 thereof.

DESCRIPTION OF THE PREFERRED EMBODIMENT

Figure 4:
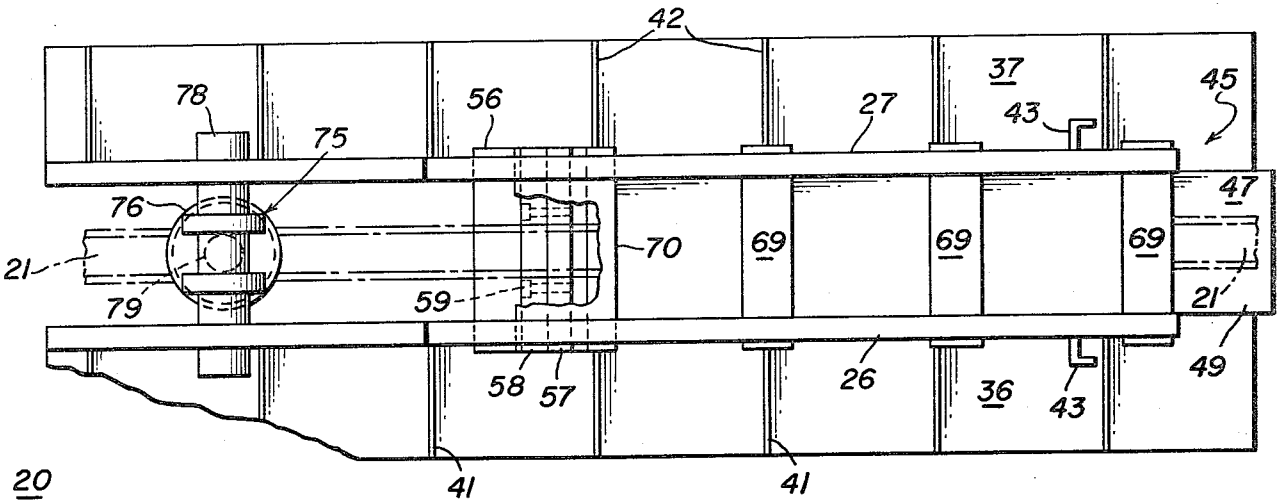
FIG. 4 is an enlarged plan view of the apparatus illustrated in FIG. 3.

Referring now to the drawings, there is illustrated an apparatus, device or machine 20 for simultaneously removing rails 21 from a railway bed and severing the rails 21 into lengths of predetermined size. The apparatus 20 is adapted to be pulled by means not shown along a railway bed which is comprised of a pair of spaced apart railway rails 21 spiked to a plurality of railway ties 22 each having a top surface 23 thereof on which the rails rest. The apparatus 20 includes a sled 25 which is comprised of spaced apart and parallel side members 26 and 27, respectively provided with apertures 28 and 29 centrally located in the upper portion of each side member. The apertures 28 and 29 are in registry and near the top of the side members 26 and 27, each of which is L-shaped. Each of the side members 26,27 is respectively provided with a generally vertically extending slot 31 and 32. For reasons hereinafter set forth each of the slots 31, 32 is positioned approximately 3° from the vertical with the bottom of the slot being closer to the front of the sled 25 and the top of the slot being closer to the rear of the sled.

A foot plate 36 is fixedly secured as by welds to the side plate 26 and a foot plate 37 is fixedly secured as by welds to the side plate 27, each of the foot plates 36,37 being adapted to slide along the top surfaces 23 of the railroad ties during movement of the sled 25 therealong. Each of the foot plates 36,37 is respectively provided with an upturned end 38,39 to ensure that the sled 25 rides smoothly on the ties 22 and does not catch or jam against a tie 22 which may be elevated with respect to the railway right-of-way or bed.

Longitudinally spaced apart along the sled 25 respectively bracing side member 26 to foot plate 36 and side member 27 to foot plate 37 are a plurality of brace members 41,42. Each of the brace members 41,42 is pie shaped and extend through approximately 90° of arc, the brace members 41 being positioned, as stated, to brace the side member 26 to the foot member 36 and the brace members 42 being positioned to brace the side member 27 to the foot member 37. Each of the brace members 41,42 is secured as by welds or the like. Finally, near the front of the sled 25 are two angle iron pulls 43 one located on each of the side plates 26 and 27 to facilitate the pulling of the sled 25 in the direction of the arrow in FIG. 1 by a tractor or the like.

A rail channel 50 through which the rail 21 is transported is defined by the side members 26,27 and a bottom rail channel plate 45 fixedly secured to the side members 26,27 as by welds 46, see FIG. 6. The bottom rail channel plate 45 has an upper support surface 47 and terminates at a rear edge 48 and has a downwardly sloping front portion 49 extending beyond the forward end of the side members 26,27. Rearward of the rear edge 48 of the bottom rail channel plate 45 is a block or blade 55. The block or blade 55 is mounted on a support plate 56 which extends between and is welded to the side members 26,27. The block or blade 55 includes a stationary member 57 forwardly positioned on the support plate 56 and a replaceable member 58 secured to the stationary member by means of two spaced apart fasteners 59. The replaceable member is preferably of hardened steel and is easily replaced.

The rail channel 50 is further defined by a top rail channel plate 65 having a bottom abutment surface 66 and a front edge 67 which is generally in registry with the front end of the side members 26,27 and a rear edge 68 which extends beyond the rear edge 48 of the bottom rail channel plate 45. The top rail channel plate 65 is fixedly secured to a plurality of longitudinally spaced apart cross bars 69 each appropriately secured to the respective side members 26,27. The rear cross bar 70 is larger than the other cross bars 69 and is also secured to the side members 26, 27 as well as to the top rail channel plate 65. As may be noted, both the bottom channel plate 45 and the top channel plate 65 extends forwardly and downwardly to define an inclined or slanted rail channel 50.

The apparatus 20 is further provided with ram means 75 in the form of a hydraulic cylinder 76 supported on the side members 26,27 by means of a support rod 78 extending through a clevis 77 at the top of the cylinder. The cylinder 76 has a piston 79 at the bottom thereof which is suitably secured to a cylindrical ram 80 by means of welds 81. The cylindrical ram 80 is positioned in the slots 31 and 32 thereby to move along a ram path defined by the slots, the slots being spaced from the vertical 3° as previously disclosed. The cylindrical ram 80 is free to move along the slots 31,32 due to the pivotal mounting of the ram means 75 to the side members 26,27, which pivotal mounting also facilitates easy servicing of the ram means 75.

Finally, control mechanism 85 is connected to the hydraulic cylinder 76 by means of inlet and outlet hydraulic lines 86, 87, the cylindrical ram 80 moving downwardly along the slots 31,32 in response to actuation of the control mechanism 85, which control mechanism may be carried by the pulling vehicle (not shown) or mounted on one of the side members 26,27.

In use, the apparatus 20 is positioned on a railway bed and one end of a rail 21 is manually pried from the ties 22 and inserted into the rail channel 50 and particularly into the forward end thereof defined by the downwardly sloping portion 49 of the bottom rail channel plate 45. Thereafter, movement of the apparatus 20 and particularly the sled 25 in the direction of the arrow in FIG. 1 causes the rail 21 which is resting on the support surface 47 to move rearwardly toward the ram mechanism 75. Continued movement of the sled 25 in the direction of the arrow causes the sled 25 and the rail 21 to reach the position illustrated in FIG. 3 wherein a predetermined length of rail 21 is behind the block 55.

Actuation of the ram means 75 by means through operation of the control mechamism 85 causes the cylindrical ram 80 to move downwardly along the slots 31,32 to contact the top of the rail 21 and to move same downwardly. Although the sled 25 and each of the component parts thereof may be made from regular carbon steel, it is preferred that the block 55 and most particularly the replaceable member 58 be made from hardened steel such as tool steel to accommodate the wear and tear due to the action of the ram 80 which causes the rail 21 to bend across the corner of the member 58. The ram means 65 is preferably a 65 ton ram with a 14 inch stroke, the cylindrical ram 80 being a 4 inch diameter rod. In use, the cylindrical ram 80 contacts the rail 21 approximately 2 foot to the rear of the block or blade 55 thereby causing the rail 21 to bend around the corner of the blade 55 and more particularly around the corner or upper rear edge of the member 59 and to snap off or be severed from the remainder of the rail 21. The rail 21 is maintained in the rail channel 50 by means of the top plate 65 and particularly the bottom abutment surface 66 thereof, it being apparent that movement of the ram 80 from the retracted position thereof to the fully extended position thereof causes the rail 21 to move upward in the rail channel 50 and contact the top rail channel plate 65.

Figure 3:
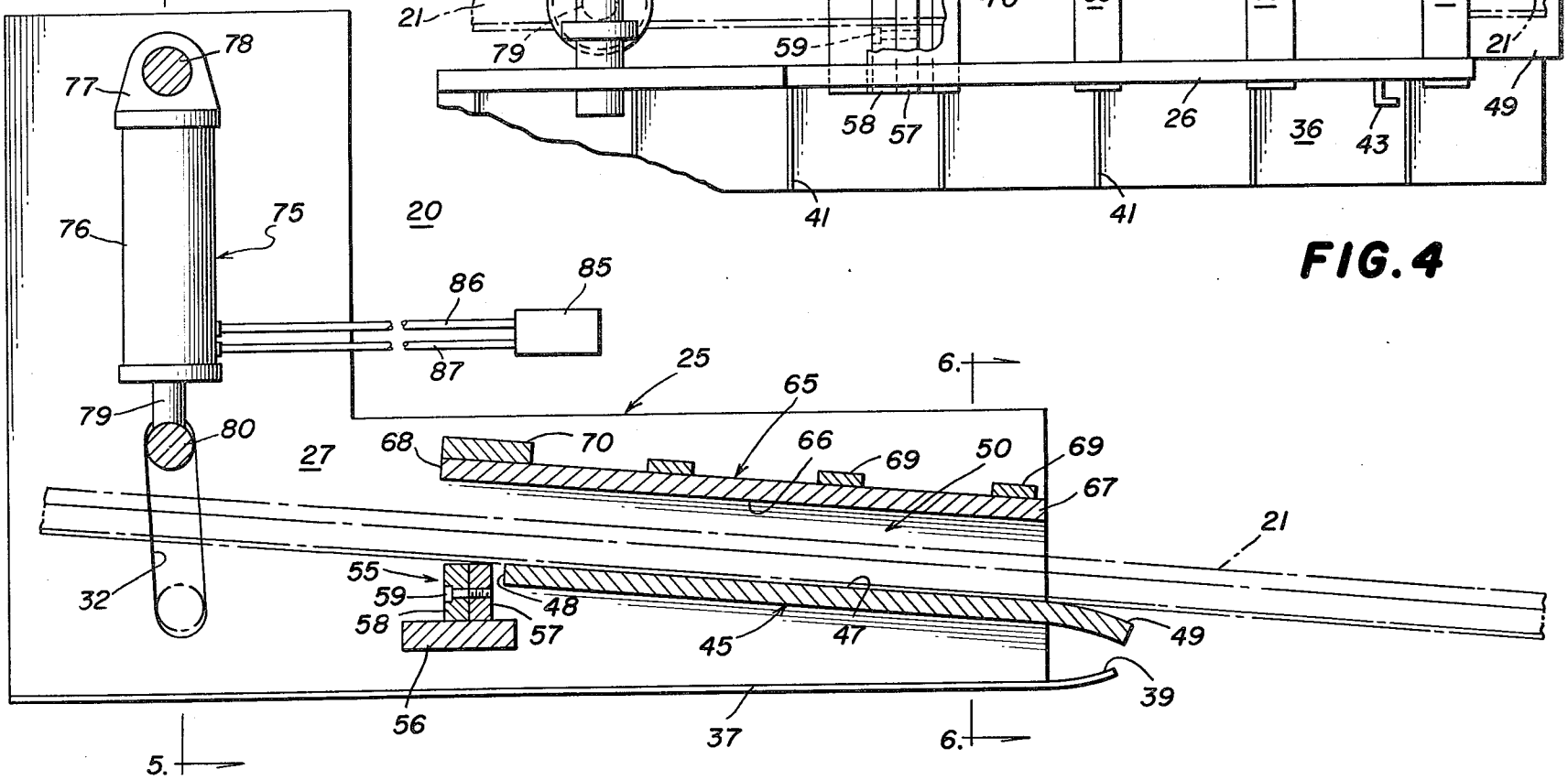
FIG. 3 is a view in section of the apparatus illustrated in FIG. 2 as seen along line 3—3 thereof.

After the stroke of the ram means 75 has been completed, and the rail section severed, the cylindrical ram 80 automatically moves to the top of the slots 31,32 and continued movement of the sled 25 in the direction of the arrow in FIG. 1 causes the rail 21 to again assume the position illustrated in FIG. 3, whereupon actuation of the ram means 75 by operation of the control mechanism 85 causes another section of the rail 21 to be severed.

The cooperation of the curved surface of the ram 80 and the positioning of the ram path defined by the slots 31,32 serve to maintain the ram 80 essentially perpendicular to the rail 21 throughout the initial bending and final severing of the rail. This is an important feature of the present invention.

Accordingly, an apparatus, device or machine has been provided for simultaneously removing and severing in situ rails from a rail bed. All the objects and advantages of the present invention have been attained by the before described preferred embodiment. It will be apparent to those skilled in the art that various modifications and alterations may be made in the foregoing described embodiment without departing from the true spirit and scope of the present invention which is intended to be covered in the claims appended hereto.

What is claimed is:

1. Apparatus for simultaneously removing and in situ severing of rails from a rail bed to produce a plurality of rail sections of predetermined lengths comprising a sled frame defining a rail channel, a block mounted on said sled frame rearwardly of said rail channel extending across said channel, ram means mounted on sled frame above the position of a rail when a rail is in said rail channel, said ram means being mounted on said frame rearwardly from said block, means defining a ram path from a level above the position of a rail in said rail channel to a level below the position of a rail in said rail channel, and control mechanism associated with said ram means for actuating said ram to travel along said ram path to contact a rail in said rail channel and force same against said block to cause the rail to fracture, whereby movement of said sled frame along the rail bed and operation of said ram means causes the rails to be lifted from the rail bed and to be cut into predetermined lengths.

2. The apparatus of claim 1, wherein said rail channel has a top plate and a bottom plate, said bottom plate extending forwardly beyond said sled frame and being downwardly curved to facilitate the passage of the rail into said channel.

3. The apparatus of claim 2, wherein said rail channel slants downwardly from the rear of said sled frame.

4. The apparatus of claim 1, wherein a portion of said block is hardened steel and is removably mounted to the sled frame.

5. The apparatus of claim 4, wherein a horizontal support is permanently mounted to said sled frame and serves to support said block.

6. The apparatus of claim 1, wherein said ram means includes a hydraulic cylinder pivotly mounted to said sled frame.

7. The apparatus of claim 1, wherein said ram path is defined by a pair of registered slots in said sled frame.

8. The apparatus of claim 7, wherein each of said slots is slanted away from the vertical with the bottom thereof toward the front of said sled to accommodate movement of said ram as it contacts the rail to maintain said ram substantially perpendicular to the rail through the ram stroke.

9. The apparatus of claim 8, wherein the surface of said ram contacting the rail is arcuate to accommodate for movement of the rail prior to fracture.

10. The apparatus of claim 1, wherein said sled frame is a pair of connected L-shaped members with said ram being pivotly mounted near the top rear and including means near the bottom front of said sled for attachment to a vehicle to pull said sled along the rail bed.

*. * * * *